United States Patent [19]

Biebuyck

[11] Patent Number: 5,036,637

[45] Date of Patent: Aug. 6, 1991

[54] ROLLED METAL BUILDING SYSTEM

[75] Inventor: Lawrence Biebuyck, Garland, Tex.

[73] Assignee: Butler Manufacturing Corporation, Kansas City, Mo.

[21] Appl. No.: 430,795

[22] Filed: Nov. 1, 1989

[51] Int. Cl.[5] ..... E04H 1/00

[52] U.S. Cl. ..... 52/235; 52/397; 52/506; 52/731

[58] Field of Search ..... 52/235, 204, 397, 461, 52/464, 476, 506, 509, 656, 731; 49/DIG. 1

[56] References Cited

U.S. PATENT DOCUMENTS

| | | | |
|---|---|---|---|
| 3,307,294 | 3/1967 | Bienenfeld et al. . | |
| 3,579,939 | 5/1971 | Eichman | 52/476 X |
| 3,720,025 | 3/1973 | Eichman | 52/204 |

FOREIGN PATENT DOCUMENTS

| | | | |
|---|---|---|---|
| 216810 | 6/1986 | United Kingdom | 52/397 |

*Primary Examiner*—Richard E. Chilcot, Jr.
*Assistant Examiner*—Creighton Smith
*Attorney, Agent, or Firm*—Johnson & Gibbs

[57] ABSTRACT

An improved mullion for a building system. The mullion has a plurality of peripheral wall and web sections defining a load bearing structure adapted for supporting the panel in sealed engagement therewith. The mullion is roll formed from thin gauged metal and further includes an integrally formed, hollow body section having portions defining a glazing pocket therein. Structural members are adapted to be disposed within the mullion body for the engagement and structural integrity thereof. The structural members are secured to the mullion body for maintaining the hollow mullion profile under loading conditions.

25 Claims, 4 Drawing Sheets

ROLLED METAL BUILDING SYSTEM

BACKGROUND OF THE INVENTION

1. Field of Invention

The present invention relates to building systems and, more particularly, to a building system incorporating rolled metal mullions accommodating the mounting of glass panels and the like.

2. History of the Prior Art

The prior art is replete with building systems incorporating a wide variety of structural mullions and panel mounting systems. These mullions are, in many instances, fabricated from extruded aluminum which provides the necessary structural support and the often complex cross-sectional configuration needed for a particular application. The shape varies between applications because a variety of designs are needed for structural and functional considerations relative to mounting numerous types of panels, such as glass, therebetween. Many conventional mullion assemblies are made from aluminum due to the fact that aluminum is both strong and may be economically extruded into the complex shapes necessary for facilitating glazing of glass panels thereon.

There are many significant parameters in the design of a building system utilizing glass panels and the like. Considerations of structural strength and glazing are two major parameters. Structural strength can be provided by very basic shapes including simple rectangular tubular designs. The necessity of incorporating pockets for receiving and sealing the edge of the glass does, however, present itself as a fabrication complexity. The complexity of the cross-sectional shape for the region of the glazing pocket has prevented widespread utilization of any material other than aluminum in today's building industry. In fact, roll-formed steel has been used in the past for not only storefront designs but also curtain wall constructions. These members are usually rolled into a cylindrical or box shape and welded. In these designs, however, the problem of mounting and sealing glass panels between mullions has substantially eliminated widespread commercial use of simple roll-formed steel. For example, conventional rolled steel columns of the type typically used in storefront areas are generally incapable of affording flush-glaze mounting of glass. To date, aluminum has been the most widely accepted mullion material for curtain wall and many storefront assemblies.

It may be seen that a significant advance within the prior art would be to provide a structural building system having the advantages of extrusion molding and roll-forming in a single system. In this manner roll-formed structural metal such as steel could be interconnected with glazing and mounting elements having a more complex cross-sectional configuration. Many prior art designs utilizing two or more materials in a single assembly are seen in several U.S. patents. These developments have addressed numerous aspects of panel designs and functional considerations for partition structures, window assemblies, column coverings, framing techniques and the like.

U.S. Pat. No. 3,371,454 issued to R. N. Anderson is a 1968 patent for a partition structure. In this patent a partition assembly is constructed with posts and horizontal members formed from aluminum extrusions. A generally H-shaped core part is formed with corner regions defining four intermediate recesses therebetween. Panels are constructed of material such as sheetrock or glass and secured between the posts and horizontal members by means of glazing channels. The glazing channel is constructed therein of polyvinyl chloride or similar semi-rigid resilient plastic and is constructed to be used in any of the four recesses of a post or a horizontal member to which it is desired to secure a panel. Closure strips are also shown to be formed of polyvinyl chloride and may be utilized to enclose any recessed area not used for a glazing channel. This combination of plastic and aluminum teaches an integration of different materials for a partition structure capable of non-destructive erection.

U.S. Pat. No. 3,225,502 issued to W. Hallauer is a 1965 patent for a composite frame. A frame of solid wood, metal or synthetic resin is taught in combination with steel clips on order of 0.5 millimeters thick. The clips engage recesses formed in the frame and in a cover strip which overlaps some longitudinal sides of the frame. The visible surfaces of the cover strips are relatively flat and in an assembled configuration define a glazing cavity therewithin. In this embodiment the structural member is enclosed within the covered strips and the structural element enclosed therein.

U.S. Pat. No. 4,648,231 issued to Francois X. LaRoche is a 1987 patent which teaches a structural joint element for panels. A primary structural joint is therein provided for panels such as glass joined together at the edges to a supporting structure such as a column. A relatively thick walled structural member, or beam, is thus constructed with a plurality of recesses for receiving a molded part in the form of a joint element therein. The joint element is utilized in combination with a molded cover strip in the mounting of glass panels to the structural beam. The joint element is constructed of substantially thinner wall construction in that it is provided in a mounting configuration for the cover strip.

U.S. Pat. No. 3,975,881 issued to James Ninowski, Jr. is a 1976 patent teaching a window frame assembly. Both aluminum and vinyl are incorporated into a frame assembly comprising an exterior frame member, an interior frame member and cooperating locking means such as snapping connections intricately formed with each of the members. The vinyl provides improved thermal qualities incorporated into this configuration. The extruded structural aluminum is specifically adapted to the particular application for the vinyl extrusion.

The above described prior art of multi-material framing/ construction manifests the direction of the prior art in attempting to utilize the most economical and useful material in a particular application. The particular application in the present invention includes relatively low-loading, storefront type mullion construction as well as some curtain wall systems. In such a construction a structured wall assembly is provided with glass panels disposed between the various horizontal and vertical structural elements. One example of such an assembly is shown in U.S. Pat. No. 3,352,078 issued to H. B. Neal. This 1967 patent utilizes a two-piece frame assembly, both formed of aluminum, to mount glass panels therebetween. The frame members are aluminum extrusions and have a generally uniform cross-section throughout their entire length. It is well known to utilize expansion joints in such constructions and this aluminum extrusion approach has thus found widespread popularity in the prior art. Most conventional mullion assemblies in such storefront profiles are made from aluminum due to the fact that the mullion shape is somewhat complex, not lending itself to roll-forming, and aluminum may be extruded. Strength is necessary for the assembly and some degree of complexity in the cross-sectional configuration is necessary for interconnection and glazing assemblies. These are seen in the Neal Patent. Other construction techniques using configurations as simple as box-shaped and cylindrical steel columns have, of course, found utility. Early attempts for curtain wall construction even incorporated roll-formed steel. One problem was the tooling necessary for particular jobs, as well as limitations in the shape that could be roll-formed. Tooling for roll-forming steel is considerably more expensive than for aluminum extrusion. For this reason, as well as shape limitations, the use of roll-formed steel has not found itself applicable to many conventional designs utilizing glazing strips. One exception is that provided by Carmel Steel Products of Santa Fe Springs, Calif. wherein steel mullions are formed from rolled steel sections. Cornerposts, jambs, vertical and horizontal mullions are therein assembled with flush glaze capacity. A sufficiently heavy gauge steel is apparently used in a welded assembly to carry the requisite static and dynamic loads. At one time such heavy gauge steel was too expensive for many applications. Changes in the relative prices of aluminum and steel have, however, necessitated a closer look at this issue.

The true, underlying needs in the design and fabrication of building system storefront mullions include considerations of strength and flexibility. Sufficient structural strength is necessary for withstanding the static and dynamic loads and design flexibility is needed relative to the glazing pocket and the glazing insert. Moreover, very thin walled steel would provide less weight and cost if a structural system could be implemented therewith that could meet the loading parameters. It would thus be an advantage to overcome the problems of the prior art by providing a system that incorporates the structural and cost advantages of thin walled, roll-formed steel as well as that of extruded aluminum. The present invention provides such an assembly by utilizing thin gauge, roll-formed steel as a comprehensive structural member and, with the glazing pocket necessitating very little structural rigidity, a lightweight material such as plastic may be molded or extruded into the requisite shape. In this manner the simplicity of various roll-formed steel designs and the lightweight, thin-walled, cross-sectional configurations thereof which provide much greater structural strength than material such as aluminum may be incorporated with such materials as plastic or aluminum to provide all the advantages, including appearance, of an extruded part with less cost, a thinner wall construction and greater reliability. In addition, the present invention provides a building system incorporating roll-formed metal that does not require welding or the wall thickness generally considered necessary in prior art systems.

SUMMARY OF THE INVENTION

The present invention relates to rolled metal mullion building systems utilizing extruded structural and glazing inserts therewith. More particularly, one aspect of the invention includes a generally U-shaped mullion roll-formed from metal in a configuration capable of receiving an extruded insert and functioning in a building system in place of extruded aluminum. Both horizontal and vertical mullions can be fabricated with this process. In a horizontal mullion, the U-shaped body is comprised of a hollow, L-shaped body section and a generally C-shaped glazing stop attached thereto. The glazing stop and body section are each integrally formed and are secured one to the other by snap fit interengagement for defining a central glazing pocket therebetween. An extruded member adapted for being received within the glazing pocket provides sealed engagement of a panel such as glass. A flush-glaze configuration is therein provided. The body section is preferably constructed with the L-shaped body region roll-formed from a single width of steel whose edges terminate along a single side thereof. The terminating edges of the roll-formed steel are not welded as in prior art systems, but are disposed opposite one another on a base web portion of the body section. In this manner a second, more shallow glazing pocket can be provided in those sections requiring same.

In another aspect, the L-shaped body section described above is roll-formed from a single width of steel and the block shaped glazing stop is roll-formed from a single width of steel into a C-shaped configuration adapted for matingly engaging the body section. The L-shaped body section is constructed with interior orthogonal web sections. A first web section is formed with an upstanding head region adapted for matingly engaging the C-shaped glazing stop. The roll-formed steel of the C-shaped glazing stop has oppositely disposed terminating edges defining a heal and a toe region thereof and adapted for engaging the head region of the body section in snap fit interengagement therewith.

In yet another aspect, extruded metal clips are provided for securement within the hollow L-shaped body section for defining the cross-sectional profile thereof. The clip includes first and second leg portions extending outwardly from an intermediate web region. The first and second leg portions are adapted for engaging oppositely disposed sections of the L-shaped body section for securement therewithin and the positioning thereof for defining the L-shaped profile and providing structural interengagement therewith. The clip further includes a pair of oppositely disposed yoke members adapted for engaging the sealing means.

In yet a further aspect, the present invention includes a mullion system operable to support a panel under loading conditions, with the mullion system comprising a mullion body member formed of thin gauged, roll-formed metal. The body member has portions defining a glazing pocket and a profile therealong. Means are provided for mounting the panel within the glazing pocket of the body member. A structural member is adapted to be disposed within the mullion body member for the engagement and structural integrity thereof. Means are also provided for securing the structural member to the mullion body member for maintaining the mullion profile under the loading conditions.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
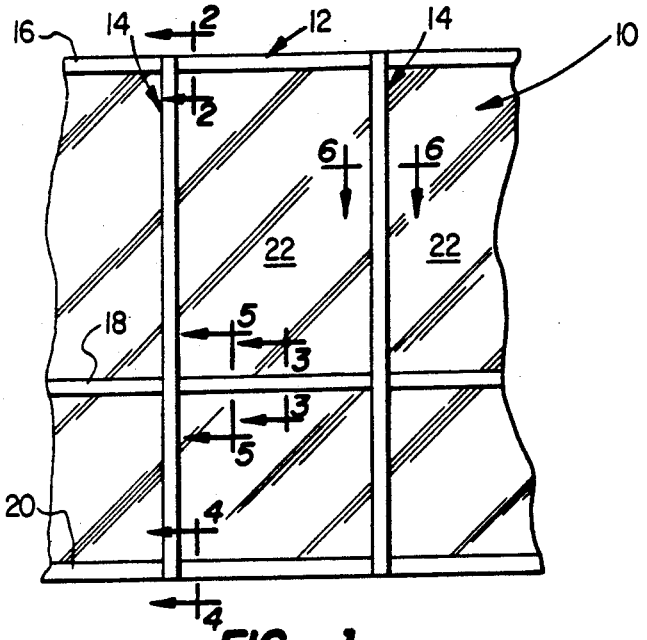
FIG. 1 is a front elevational view of a section of a building system constructed in accordance with the principles of the present invention.
Figure 2:
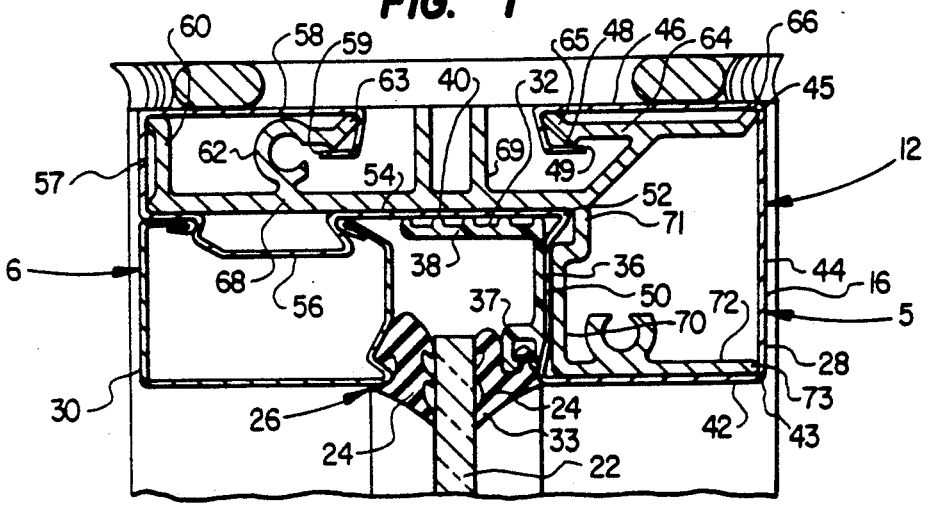
FIG. 2 is an enlarged, side elevational, cross-sectional view of the upper horizontal mullion, or header, of FIG. 1 taken along the lines 2—2 thereof.

Referring first to FIG. 1, there is shown a wall structure comprising the building system 10 of the present invention. A plurality of horizontal mullions 12 are linked to a series of vertical mullions 14 providing means for securing glass panels therebetween. The horizontal mullions 12 include, in the present embodiment, a header 16, an intermediate, horizontal mullion 18 and a sill 20. Glass panels 22 are secured between the horizontal mullions 12 and vertical mullions 14. Multiple sections are taken through mullions 12 and 14 to show incorporation of the generally U-shaped mullion, roll-formed from metal such as thin gauged (including steel with a thickness on the order of 0.029 inches) steel in a configuration capable of functioning in a building system in place of extruded aluminum. The term thin gauged as used herein includes metal thicknesses on the order of 0.029 inches as well as other thicknesses. Such thin gauged metal does not generally afford sufficient structural strength. In the present invention, this strength is accomplished in the horizontal mullions 12 by utilizing a hollow, integrally formed, generally L-shaped body section 28 and a hollow, block shaped glazing stop 30, mounted thereon and upstanding therefrom, as shown in FIG. 2. The vertical mullion 14 is comprised of two rolled metal sections also forming a generally U-shaped member. A central glazing pocket 26 is formed in the U-shaped members for receipt of glass panels 22. With the utilization of certain extruded elements secured within the assembly, all of the advantages of an integrally formed extruded mullion can be merged with the advantages of a roll-formed member. The actual design and construction thereof will be described in more detail below.

Referring now to FIG. 2, there is shown an enlarged, cross-sectional view of the header 16 of FIG. 1 taken along lines 2—2. The body 28 and glazing stop 30 of header 16 are shown defining the glazing pocket 26 described above. Within the glazing pocket 26, glass panel 22 is mounted and sealed by glazing gasket 24 secured within the glazing pocket 26. The hollow glazing stop 30, also constructed of rolled metal such as steel, is demountably secured to the body 28. The glazing pocket 26 is defined between the glazing stop 30 and the L-shaped body section 28. A glazing adapter 32 is shown secured within the glazing pocket 26 for securing glazing gasket 33, as described in more detail below. Also described below is a second configuration of a glazing adapter 33 which may be used complementally in opposition therewith.

Still referring to FIG. 2, the glazing adapter 32 is formed by extrusion, or the like, in a generally L-shaped configuration. A first body section 36 is provided from which a jaw section 37 extends for engaging and interlocking the underside of glazing adapter 33. A second, orthogonal adapter section 38 extends from the end of body section 36, opposite the jaw region 37, for positioning against the base or end of the glazing pocket 26, as described below. A plurality of feet 40 are formed therealong for abutting engagement against the bottom of glazing pocket 26. It may be seen that the glazing adapter 32 is thus formed with a intricate cross-sectional configuration such as the jaw section 37 and feet 40. Fabrication of these sections from rolled metal would be difficult and expensive, if at all possible. It is for this reason that the glazing adapter 32 is formed from extruded aluminum or plastic for complemental engagement with the roll-formed steel body 28. The body 28 is thus formed for matingly engaging and receiving the glazing adapter 32 and utilizing the intricate constructional aspects thereof for maximum utilization in the building system 10.

Referring still to FIG. 2, the construction of the roll-formed steel body 28 includes a first interior, horizontal, header surface 42 extending from glazing pocket 26. Surface 42 is rolled about a right angle corner 43 into interior vertical surface 44 formed orthogonal thereto. A second interior, horizontal, header surface 46 is bent back in generally parallel spaced relationship to surface 42 and ends in a rolled lip region 48 terminating along edge 49. The rolled configuration of lip 48 allows edge 49 to manifest large tolerance variations from the "run-out" typical in roll-formed steel fabrication. This particular shape permits run-out variations in an insignificant area. With run-out along edge 49 thus accommodated, the glazing pocket 26 is specifically and accurately defined by vertical web 50 of roll-formed body 28. Web 50 is constructed with a rear angulation forming an elbow 52 extending outwardly from a lateral web 54 which defines the back of glazing pocket 26 upon which feet 40 rest. An enlarged head section 56 is formed outwardly of lateral web 54 and in a configuration facilitating interengagement with and locking of glazing stop 30, as defined in more detail below. The head 56 provides additional vertical dimension to this area of the structured body 28 and then terminates along outside wall 57 roll-formed therefrom. Top outside surface 58 is roll-formed orthogonally from wall 57. Material edge 59 is likewise rolled back into generally parallel spaced relationship with surface 58 and oppositely disposed to edge 49. Edges 49 and 59 therein provide for complemental runout of the rolled metal in an insignificant area. In this particular L-shaped configuration, structural reliability is afforded with maximum efficiency in a rolled metal formation.

As described above, the present invention provides a building system 10 utilizing rolled metal such as steel in place of extruded aluminum. Most horizontal mullions are fabricated from extruded aluminum in order to provide the necessary intricacies of design. However, the present invention allows for the intricacies to be provided at specific regions of the mullions 12 and 14 by inserts. Such inserts include the glazing adapters 32 and 33 and the extrusion discussed below.

Referring still to FIG. 2, a shear block 60 is shown disposed in the end section of header 16 adjacent the vertical mullion 14 to which it is secured. By utilizing the advantages of extruded aluminum in association with the roll-formed metal body 28 of horizontal mullions 12, maximum advantage may be taken of the structural and manufacturing aspects of roll-forming as well as the economic advantages thereof. The utilization of extruded aluminum in the formation of shear block 60 further serves to define the cross-sectional configuration of the roll-formed steel body 28 as it comprises header 16. If there is any misalignment in the roll-forming process, the shear block 60 will redefine the cross-sectional profile. In this regard, a first leg 62 is constructed with a foot 63 extending outwardly therefrom, which foot 63 is adapted for matingly engaging the inside of the lip formed between edge 59 and top surface 58 of the roll-formed steel body 28. In this manner, the precise cross-section configuration of this roll-formed region is defined and maintained at its juncture with the vertical mullion 14. Likewise, a second, oppositely disposed leg 64 is constructed with an outstanding, inwardly directed foot 65 which matingly engages the lip 48 adjacent edge 49. Opposite to foot 65 is end 66 which is secured within the corner 45 of roll-formed body section 28 to further define that corner region opposite corner 43. In this manner, surfaces 42, 44 and 46 may be configured in the requisite orthogonal relationship. Similarly, an intermediate insert web 68 forms a structural area comprising the region of abutment of glazing stop 30 and the position of the web 54 thereagainst. This surface defines the bottom of glazing pocket 26 upon which the glazing adapter 32 is seated. Legs 69 serve as structural spacers, in this particular mounting, for maintaining the position of the shear block. An intermediate, vertical web 70 is constructed with a pocket 71 extruded therewith from which leg 64 projects and in which elbow 52 of rolled steel body 28 extends. Likewise region 72 extends orthogonally from vertical web 70, with an edge 73 defining the precise location of corner 43 between orthogonal surfaces 42 and 44 of the rolled steel body 28. As discussed in more detail below, shear blocks 60 establishes the overall cross-sectional configuration of the mullion.

Figure 3:
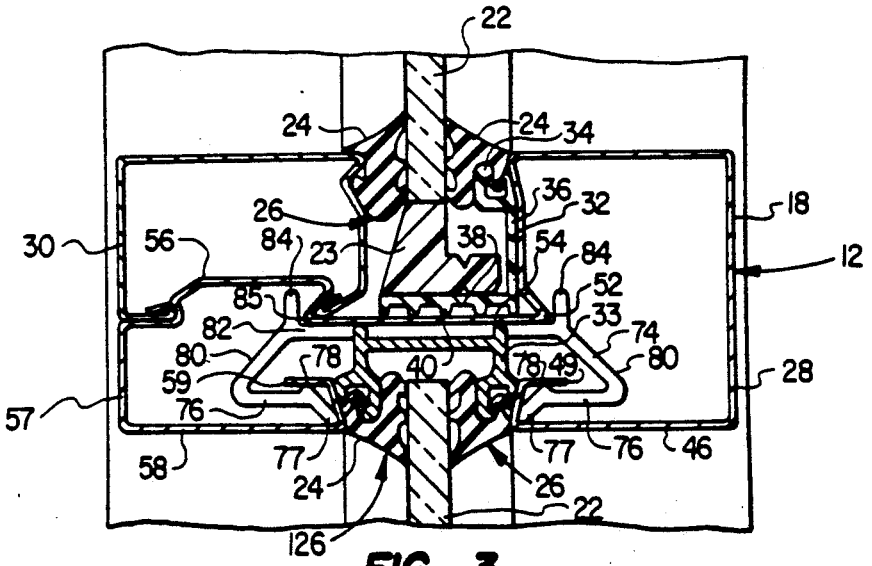
FIG. 3 is an enlarged, side elevational, cross-sectional view of the intermediate horizontal mullion of FIG. 1 taken along the lines 3—3 thereof.

Referring now to FIG. 3, there is shown an enlarged side-elevational cross-sectional view of the intermediate horizontal mullions 18 of FIG. 1 taken along the lines 3—3 thereof. As shown herein the rolled steel body 28 of the intermediate horizontal mullions 12 is positioned in an inverted configuration relative to the header 16 of FIG. 1. This is because the large glazing pocket 26 must face upwards and be disposed beneath the glass pane 22. In this manner, seating block 23 may be positioned under said glass for its support. The L-shaped seating block 23 is shown resting upon the glazing adapter 32.

Other than the inverted configuration, the rolled steel body 28 of intermediate horizontal mullion 18 is identical in construction to header mullion 16. Lines 3—3 are, however, taken in the area to the right of the midspan of mullion 18, and at this general location a structural clip 74 is preferably utilized for improving the dead load capacity of the mullion 18. The clip 74 is not sectioned because it appears, preferably, at midspan (to the left of the section line) and therefore the section lines cut only through the glazing adapter 33. The rolled steel edges of mullion 18 are seen to terminate along edges 49 and 59. At this point flare-out can theoretically occur from dead loads and the present invention addresses this structural aspect. Clip 74 may be formed of extruded aluminum or the like and with it, welding and other conventional assembly techniques can be eliminated. It is used as an integral element in this intermediate mullion 18 to manage the mullion profile and control flare-out by maintaining the cross-sectional configuration established by shear blocks 60 secured in each end. The clip 74 comprises one of the elements of complex or intricate design discussed above that may be provided in a configuration complemental to the basic roll-formed structure of the body 28. Such is the case with clip 74 constructed with oppositely disposed feet 76. Each of oppositely disposed feet 76 is constructed with toe and heel portions 77 and 78, respectively. Toe portions 77 engage the inside ends of surface 58 and 46 for defining the lip area thereof terminating in edges 59 and 49, respectively. It is this region in the header 16 described in FIG. 2 which is secured by end sections 63 and 65 of the shear block 60.

Referring still to FIG. 3, upstanding from feet 76 are leg regions 80 formed at an angle relative to intermediate body section 82 extending laterally thereacross. Upstanding from body section 82 are oppositely disposed collar sections 84 which are disposed outwardly of the web 54 at the back of glazing pocket 26. It may be seen that sufficient spacing is provided for elbow 52, received adjacent collar 84. The elbow 52 and an inset 85 of head 56 are generally symmetrical about the center-line of mullion 12 as represented by glass 22.

Figure 4:
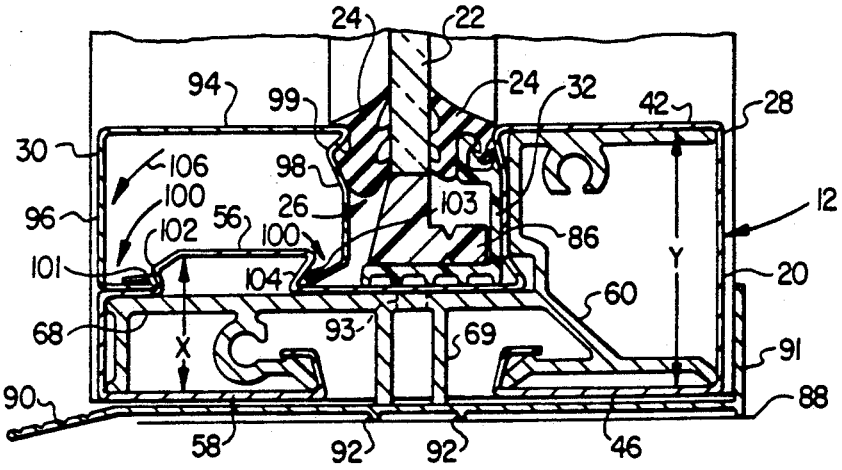
FIG. 4 is an enlarged, side elevational, cross-sectional view of the lower horizontal mullion, or sill, of FIG. 1 taken along the lines 4—4 thereof.
Figure 12:
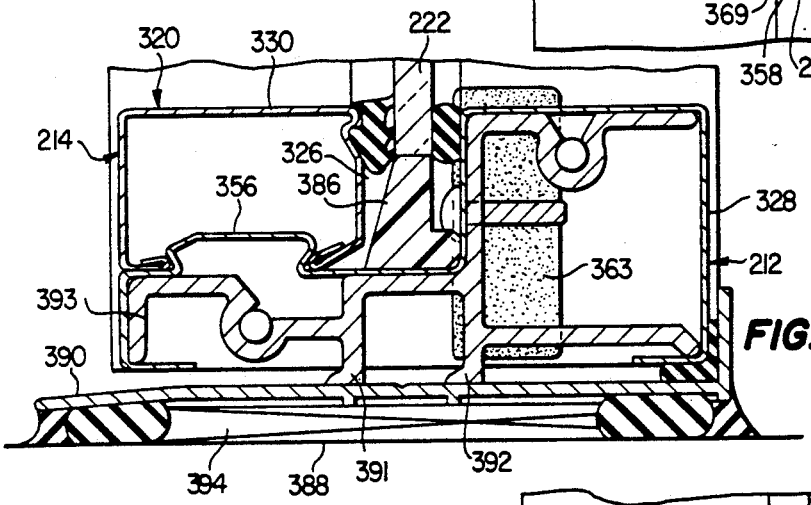
FIG. 12 is an enlarged, side elevational, cross-sectional view of the lower horizontal mullion, or seal, of FIG. 7 taken along lines 12—12 thereof.

Referring now to FIG. 4, there is shown one embodiment of the lower horizontal mullion 12 comprising sill 20. (A second, more expanded version is shown in FIG. 12) As shown herein, a lower setting block 86 is shown received within glazing pocket 26 for supporting the lower end of glass pane 22 above a floor surface 88. Surface 88 may be formed of concrete or the like for supporting the horizontal sill 20 as well as the vertical mullion 14. A flashing 90 is often used, which flashing is constructed with an inside flange 91 and a plurality of feet 92. The flashing lies between the sill 20 and the support surface 88. Connecting members such as bolts (not shown) may be utilized between legs 69 for securement therethrough. Dotted lines 93 illustrate the location of bolt clearance holes spaced along sill 20 for receipt of the fastening member therethrough. Legs 69 of shear block 60 resist positive and negative loads thereon. It may be seen that the construction of the roll-formed steel body 28 of sill 20 is identical both in cross-sectional size, shape and orientation to that of intermediate horizontal mullion 18. Even the glazing stop 30 is positioned in the same location as that shown in FIG. 3 for facilitating installation of the glass pane 22.

Still referring to FIG. 4, generally C-shaped glazing stop 30 is constructed of roll-formed steel in a size and configuration complemental to body section 28. Top surface 94 thus corresponds to surface 42 of body section 28. In this assembled configuration with the shear block 60 positioned therein, the C-shaped glazing stop 30 and L-shaped body 28 together form a wide U-shaped member. The glazing stop 30 is constructed with a top wall 94 which is formed orthogonal to an outside wall 96 roll-formed therefrom. Top wall 94 is also generally orthogonal to inside wall 98 which is constructed with a detent section 99 adapted for interengaging the glazing gasket 24 shown therein. Glazing stop side wall sections 96 and 98 terminate in oppositely disposed ends 100 adapted for matingly engaging opposite sides of head section 56. A lip 101 is formed at the end of a right angle flange portion of side wall 96 while angulated lip section 103 is formed at the end of a section depending from inside section 98. Neck regions 102 and 104 formed in head section 56 engage lip sections 101 and 103, respectively, of glazing stop 30. In this configuration, attachment of glazing stop 30 through ends 100 to head section 56 is provided by a toe to heel interengagement. Angulated section 103 defines a toe region in glazing stop 30, with oppositely disposed heel section 101 disposed opposite thereto. During assembly, toe region 103 is inserted within inside neck region 104 with the glazing stop 30 rotated downwardly in the direction of arrow 106 for snapping heel section 101 within detent of collar 102. This interlocks the glazing stop 30 and structurally interconnects glazing stop 30 and steel body 28 into the wide U-shaped configuration defined above. This toe to heel installation feature is critical to proper assembly and the structural integrity of the overall system.

Referring still to FIG. 4 for purposes of illustration, the height X of head 56 from surface 58 is approximately equal to or greater than one-half of the distance Y between surfaces 42 and 46. This dimension has been shown to be critical in achieving the requisite structural integrity in certain applications such as the intermediate horizontal mullion 18 of FIG. 3. It is particularly important since it also is instrumental in the interengagement of glazing stop 30 by defining head 56. These are structural surfaces in the roll-formed body 28 and distances therebetween define the location of the neutral axis of the body. The distances are important for those applications where dead load must be dealt with by the structure, such as the intermediate horizontal mullion 18.

Figure 5:
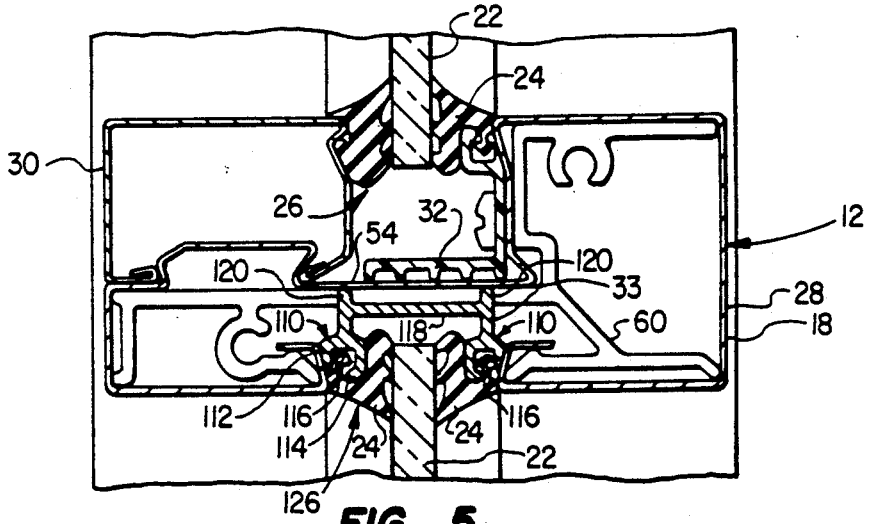
FIG. 5 is an enlarged, side elevational, cross-sectional view of the intermediate horizontal mullion of FIG. 1 taken along the lines 5—5 thereof.

Referring now to FIG. 5, there is shown an enlarged side-elevational cross-sectional view of the portion of the intermediate horizontal mullion 18 adjacent the vertical mullion 14 taken along lines 5—5 thereof. In this location, shear block 60 is illustrated in the mullion 18. This view may be compared to that of FIG. 3 taken in the vicinity of midspan in horizontal mullion 18 where clip 74 has been inserted. At opposite ends of the horizontal mullion 18 the shear block 60 is utilized as set forth above for defining the cross-sectional configuration and further insuring the structural integrity of the roll-formed steel body 28. In this particular view, the section is taken to the right of section 2—2 at the section lines 5—5 thus extend through glazing adapter 33 instead of shear block 60. The glazing adapter 33 is easily cut to provide clearance for the shear blocks 60 as well as clip 74.

Still referring to FIG. 5, and as stated above, two types of glazing adapters are incorporated within the present embodiment of the building system 10. Glazing adapter 33 is utilized in a shallower glazing pocket 126 in a position oppositely disposed to the glazing adapter 32 positioned in larger glazing pocket 26. The separate glazing pocket 126 defined in this particular region is necessary for intermediate mullions. The glazing adapter 33 is only used in this application. It may be seen that the relatively intricate cross-sectional configuration of the glazing adapter 33 is necessary for properly engaging and structurally interconnecting the glazing gaskets 24 on opposite sides of glass pane 22. It is for this reason that the glazing adapter 33 is constructed with oppositely disposed yoke sections 110. Each yoke section 110 is formed with oppositely disposed yoke members 112 and 114 which engage projections 116 of the glazing gasket 24. An intermediate web 118 connects the oppositely disposed yokes 110 in structural interengagement, while feet 120 extend upwardly therefrom for engagement with the lateral web 54 of roll-formed steel body 28. The glazing adapters 33 and 32 thus sandwich lateral web 54 therebetween and provide secured structural interengagement thereof. The thin-walled, rolled steel body 28 is thus feasible and the cross-sectional configuration thereof is reduced in complexity due to the fact that most of the intricate and complex shapes may be provided by the insertable members 60, 32 and 33. Member 60 can be extruded to provide an accurate profile without the conventional quality control problems. This substantially reduces production costs and permits a fairly inexpensive configuration to find a variety of uses with great structural reliability. To complete that reliability however a vertical mullion is necessary for interconnection and support.

Figure 6:
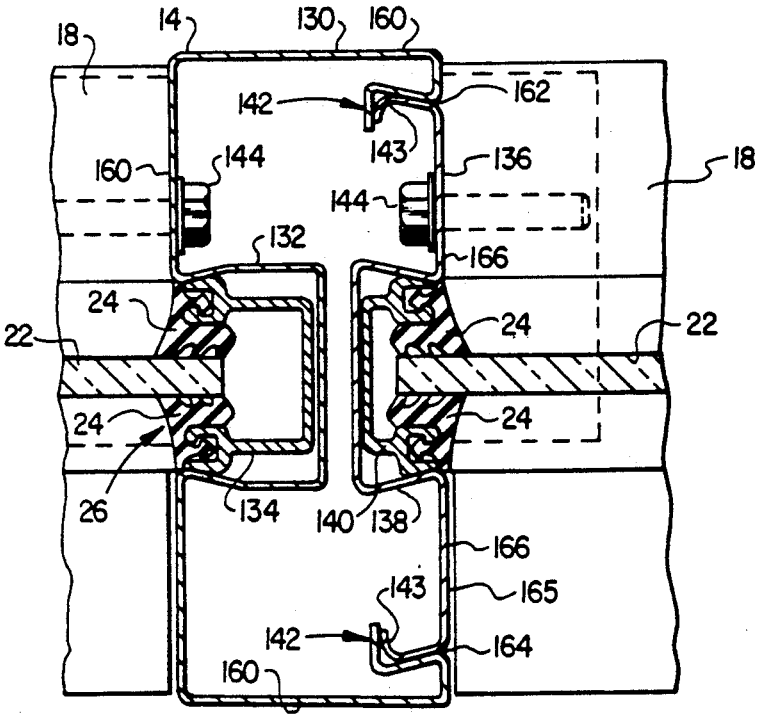
FIG. 6 is an enlarged top plan, cross-sectional view of the vertical mullion of FIG. 1 taken along lines 6—6 thereof.

Referring now to FIG. 6, there is shown a enlarged top-plan cross-sectional view of the vertical mullion 14 of FIG. 1 taken along line 6—6 thereof. Glass panes 22 are shown oppositely disposed one another and between glazing gaskets 24. Intermediate horizontal mullions 18 are shown disposed beneath the glass panels 22. The vertical mullion is constructed of two interlocking rolled metal sections. First interlocking section 130 is roll-formed with a glazing pocket 132 integrally constructed therein. An extruded glazing adapter 134 is inserted within glazing pocket 132. The construction of the glazing adapter 134 is very similar to that of glazing adapter 33 except that no feet 120 are included. Gaskets 24 are secured within the glazing pocket 132 to seal and secure glass pane 22 therein as defined above. Likewise, the opposite lateral surface of the vertical mullion 14 is constructed of a rolled steel section 136 having a relative shallow glazing pocket 138 integrally formed therein. A glazing adapter 140 is positioned within the glazing pocket 138. It is of a very similar design to that of glazing adapter 134 with a shorter height in order to facilitate the more shallow depth. The rolled steel sections 130 and 136 are locked together through mating interconnection of ends 142 and 143. More than one interconnecting configuration is possible although the configuration of ends 142 and 143 has been found acceptable in accordance with the principles of the present invention.

Referring still to FIG. 6, it may be seen that the roll-formed metal sections of the mullion 14 of the present invention provides a similar aspect to its fabrication as provided by the horizontal mullions 12 described above. That aspect is the advantage of a single exposed surface along each member. For example, roll-formed body section 130 has an outside surface 160 that continues uninterrupted in outward exposure throughout the entire peripheral area of member 130. Interconnection areas 162 and 164 appearing along side 165 of mullion 14 are the only interruptions to this continuous surface. At these points, however, second interlocking member 136 is in engagement therewith, and member 136 likewise has a continuous exposed side 166 which is constantly facing outwardly throughout the peripheral extent of this member. In this manner, the metal being utilized for fabrication of the rolled steel body may be treated on a single side and yet provide that surface treatment on the entire outside surface of the rolled steel mullion 14. This is likewise true of the horizontal mullions 12 described above wherein a single side is exposed to thereby facilitate the utilization of a single-sided surface treatment. Such material blanks may even be treated on opposite sides with different colors which has the distinct advantage of reducing the amount of inventory necessary for various applications. This single-side treatment advantage is incorporated in an assembly that provides the improved structural integrity as well as flush-glazed capability not heretofore possible. As described above, it has been well known in the prior art to use various configurations of roll-formed systems. However, these systems do not incorporate the structural and functional advantages described herein.

Figure 7:
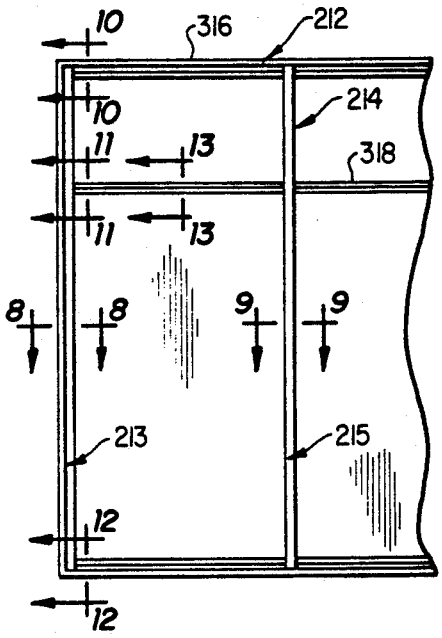
FIG. 7 is a front elevational view of a section of an alternative embodiment of the building system constructed in accordance with the principles of the present invention.

Referring now to FIG. 7, there is shown an alternative assembly configuration of the building system 10 of the present invention. A plurality of horizontal mullions 212 are linked to a series of vertical mullions 214 providing means for securing glass panels 222 therebetween. The horizontal mullions 212 include, in the present embodiment, a header 216, an intermediate, horizontal mullion 218 and a lower sill 220. Glass panels 222 are secured between the horizontal mullions 212 and vertical mullions 214. Multiple sections are taken through the mullions 212 and 214 to show incorporation of the roll-formed mullions.

Figure 8:
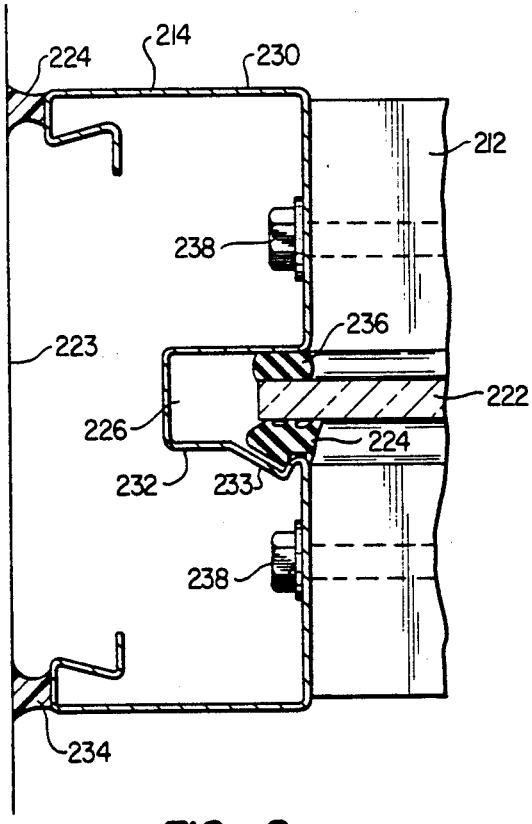
FIG. 8 is an enlarged, top plan, cross-sectional view of the vertical jamb of FIG. 7 taken along lines 8—8 thereof.

Referring now to FIG. 8, there is shown a top plan, cross-sectional view of a portion of a vertical mullion 214 forming a jamb 213. This view of jamb 213 is taken along the lines 8—8 of FIG. 7. Glass pane 222 is shown disposed between glazing gaskets 224. Intermediate horizontal mullion 218 is shown disposed beneath the glass panel 222. In this configuration, the jamb 213 is constructed of a single rolled metal section which is sealed adjacent a column or wall section 223. The manner of securement may be conventional and is not shown herein for purposes of clarity. What is shown is the placement of sealant 224 on opposite sides of said jamb. The body 230 of the jamb 213 is constructed with a roll-formed glazing pocket 232 integrally constructed therein. An extruded glazing adapter of the type described above is not utilized in this particular configuration. The side wall 233 of the glazing pocket is, however, roll-formed outwardly to provide a seating recess for a glazing gasket 224. On the opposite side of the glass 222 from glazing gasket 224 is a modified version of the glazing gasket forming a glazing strip 236. Also shown is a pair of threaded bolts 238 illustrated securing the horizontal mullion 212 therebeneath to the vertical mullion 214 as described in more detail below.

Figure 9:
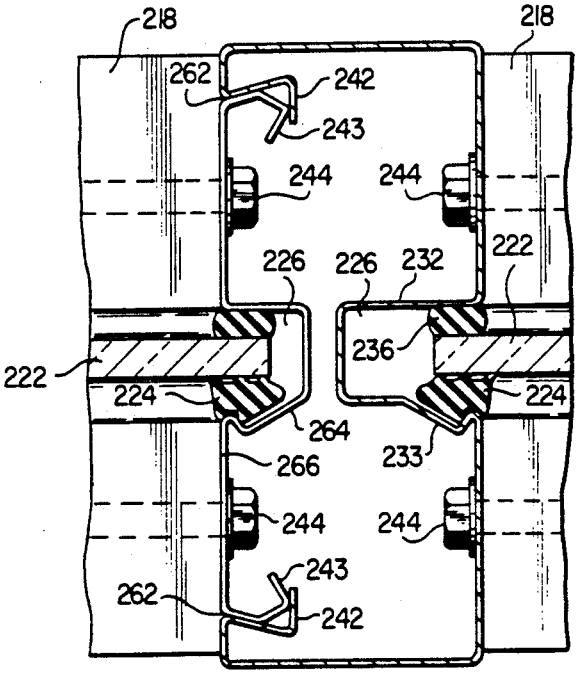
FIG. 9 is an enlarged, top plan, cross-sectional view of the vertical mullion of FIG. 7 taken along lines 9—9 thereof.

Referring now to FIG. 9, there is shown an enlarged top plan cross-sectional view of the vertical mullion 215 disposed between adjacent glass panels 222. The figure is taken along lines 9—9 of FIG. 7. Intermediate horizontal mullions 218 are shown disposed beneath the glass panels 222 and secured to vertical mullion 215. The differences in fabrication of the sections of vertical mullion 215 relative to the vertical mullion illustrated in FIG. 6 are clearly shown. In this alternative embodiment of the vertical mullion construction it may be seen that flange region 242 matingly engages flange region 243. Flange 243 is roll-formed into a general L-shaped configuration as compared to the arcuate configuration shown in FIG. 6. The interface 262 between flange sections 242 and 243 is also illustrated. Of more design significance in this alternative embodiment is the construction of the glazing pocket 226. Side wall sections 233 and 264 of mating mullion sections are constructed of an angulated configuration adapted for matingly engaging the glazing member 224 disposed adjacent thereto. Angulation such as that necessary for matingly engaging a glazing member 224 is provided by the roll-formed configuration. Other modifications include the utilization of the glazing strip 236 which is constructed to be adhered to the side wall 232 of the glazing pocket for serving as a glazing and positioning member relative to glass pane 222. In accordance with the principles of the present invention, a wide variety of design variations may be accommodated including the modification of the glazing pocket profile and the glazing members disposed therein.

Figure 10:
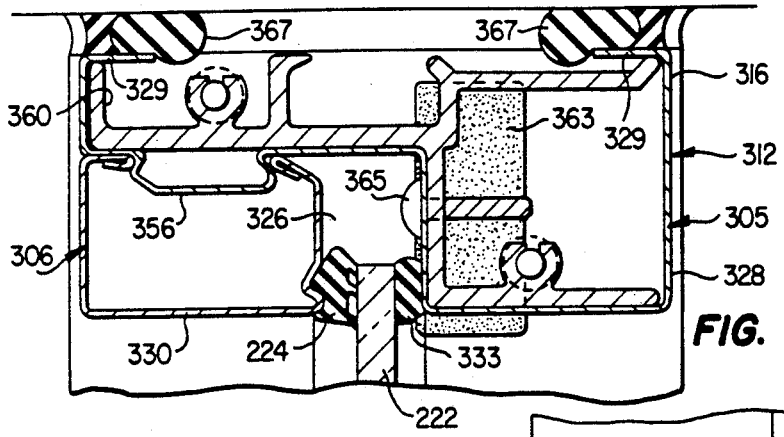
FIG. 10 an enlarged, side elevational, cross-sectional view of the upper horizontal mullion, or header, of FIG. 7 taken along lines 10—10 thereof.

Referring now to FIG. 10, there is shown an enlarged, cross-sectional view of the header 316 of FIG. 7 taken along lines 10—10 thereof. The body 328 and glazing stop 330 of header 316 are shown defining glazing pocket 326. Within the glazing pocket 326, glass panel 222 is mounted and sealed by glazing member 224. Hollow glazing stop 330, also constructed of thin walled, roll-formed metal such as steel, is demountably secured to the body 328. The glazing pocket 326 is defined between the glazing stop 330 and the L-shaped body section 328. A glazing adapter of the type illustrated in FIGS. 2–6 above, is not needed within the glazing pocket 326 as shown herein for securing glazing member 224. The glazing adapter facilitates use of a dry glazing member such as member 24 on both sides of the glazing pocket 26. In some areas of the country, the dry glazing members on both sides of the glass is a preferred method of assembly. In addition, the appearance of the dry glazing wedge on both sides of the infill imparts a level of higher quality as compared to a wedge and sponge tape combination. The absence of the necessity for a glazing adapter is due to the shape of the side wall of the glazing pocket 326. However, a second configuration of a glazing adapter 333 is described below.

Still referring to FIG. 10, the construction of the roll-formed steel body 328 includes a design variation in the upper body region 329 as compared to that described for the header 16 of FIG. 2. In the present embodiment, region 329 comprises oppositely disposed flanged sections rather than the abutting header surface 46 of FIG. 2, which is bent backwardly in generally parallel spaced relationship to bottom surface 42 and ends in a rolled up region 48 terminating along edge 49. In the present invention the lip surfaces are not rolled back. Instead, region 329 has a limited surface area and an exposed region is provided, which exposed region may be seen to be incorporated in both the header 316 and sill 320 of FIG. 12.

Referring still to FIG. 10, an enlarged head section 356 is formed for mating and locking engagement of the glazing stop 330, which may be identical to stop 30 described above. The head 356 provides additional vertical dimension to this area of the structured body, also as described above. A variation in the cross-sectional profile of the shear block is likewise shown herein and described below. Shear block 360 is shown to be formed of extruded aluminum, or the like, to further define the cross-sectional configuration of the roll-formed steel body 328 comprising header 316. Again, if there is any misalignment in the roll forming process, this shear block 360 will redefine the cross-sectional profile. Also seen in this particular view is the use of mounting tape 363, which mounting tape is used to seal the head section and shear block 360 at mullion 214. Also shown is a mounting screw 365 further facilitating interengagement between the roll-formed steel body 328 and the extruded aluminum shear block 360. Sealing backer rod 367 are likewise shown disposed thereabove which sealing gaskets are used in the assembly of the structure utilizing the header 316.

Figure 11:
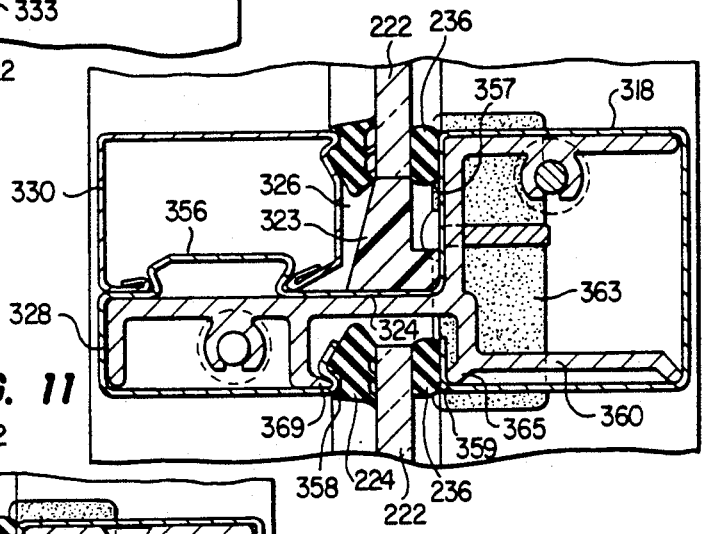
FIG. 11 is an enlarged, side elevational, cross-sectional view of the intermediate horizontal mullion of FIG. 7 taken along lines 11—11 thereof.

Referring now to FIG. there is shown an enlarged side elevational cross-sectional view of the intermediate horizontal mullion 318 of FIG. 7 taken along lines 11—11 thereof. As shown herein the rolled steel body 328 of the intermediate horizontal mullion 212 is positioned in an inverted configuration relative to the header 316 of FIG. 10. This is because the large glazing pocket 326 must face upwardly and be disposed beneath the glass pane 222. In this manner, setting block 323 may be positioned under said glass for its support. The L-shaped setting block 323 is shown resting upon a lower web 324 of the roll-formed body 318, said web being disposed adjacent the head 356 described above. Again in this view, the adhesive 363 is shown disposed adjacent the end of the mullion. Likewise the glazing pocket 326 is formed with a generally planar wall surface 357. The utilization of a glazing gasket 236 of the type having adhesive formed on at least one side thereof provides a commercially acceptable means for mounting the glass pane 222 thereagainst. It may likewise be seen that the shear block 360 is constructed with lower feet 365 and 369 which serve to define a region for securement of the glass pane 222. A discreetly enclosed glazing pocket is not formed in this region. Instead, the cross-sectional profile of the roll-formed body 328 is secured by the shear block 360 and the glazing members 224 and 236 are positioned thereagainst and along the edges of the roll-formed body 328 for securement of the glass pane therein. It may be seen that the variations between the structure shown in FIG. 11 and that of FIG. 5 is minimal. The design of FIG. 11 eliminates the need for the separate glazing adapter 33. In the configuration shown, the foot of 369 is presented relative to the roll-formed body 328 for complemental engagement with the glazing gasket 224. Similar modifications to the design may likewise be incorporated within the spirit and scope of the present invention.

Referring now to FIG. 12, there is shown the lower horizontal mullion 320. A lower setting block 386 is shown received within the glazing pocket 326 for supporting the lower end of the glass pane 222 above a floor surface 388. As above, surface 388 may be formed of concrete o the like for supporting the horizontal sill 320 as well as the vertical mullion 214. However, unlike the sill 20 of FIG. 4 described above, the spacing of the flashing 390 as well as the engagement thereof by feet 391 and 392 is modified. Feet 391 and 392 extend from a sill shear block 393. The shear block 393 is formed with a modified cross-sectional configuration relative to the shear block 360 of FIGS. 10 and 11. In this configuration, the extension of feet 391 and 392 provide direct structural engagement between the vertical mullion 214 into which it is directly secured and the underlying surface 388. It is seen that this assembly provides the ability to raise the structural system of the mullions 212 and 214 off of surface 388 which, in many instances, is a concrete slab. Flashing is not always used but it is shown herein for purposes of illustration. By raising the structural system of mullions 212 and 214 Off of the surface 388, they are generally raised out of the corrosive water level.

As shown in FIG. 12, inserts or shims 394, generally formed of wood, plastic, or the like, are disposed beneath the flashing 390. It is the flashing 390 (when used) that is in contact with the moisture to which the mullion is generally exposed. Moreover, it is the flashing 390 that would ordinarily carry the corrosive water to the structural system thereabove. In the present case, the structural system of mullions 212 and 214 is rolled steel. It is known that rolled steel will corrode, particularly with prolonged exposure to moisture in such loaded configurations. In the present invention, the aluminum shear block extends downwardly with the extended leg regions 391 and 392 directly engaging the aluminum flashing where water contact will normally occur. The steel horizontal mullion 320 comprising the sill will then be disposed sufficiently above the flashing to permit air currents to flow and facilitate drying. Since the steel of sill 320 is not in direct contact with aluminum, galvanic corrosion should be substantially eliminated. Moreover, in this configuration, the dead load of the wall itself will be carried not from the vertical mullions 214 to the slab 388, but through the shear block 393. The shear block 393 directly transfers the load from the vertical mullion 214 to the flashing 390 and the support shims 394 disposed therebeneath. This eliminates the dead load across the sill as well as any dead load directly from the vertical mullions 214.

Figure 13:
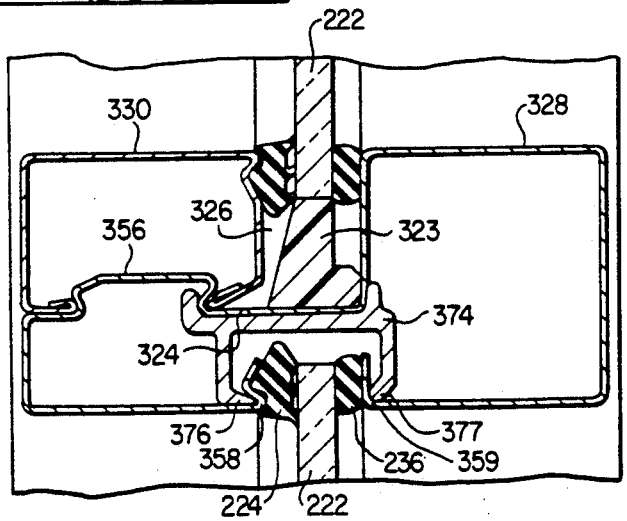
FIG. 13 is an enlarged, side elevational, cross-sectional view of the horizontal mullion of FIG. 7 taken along lines 13—13 thereof.

Referring now to FIG. 13, there is shown an enlarged side elevational cross-sectional view of the intermediate horizontal mullion 318 of FIG. 7 taken along lines 11—11 thereof. As shown herein, the roll-formed, steel body 328 of the intermediate horizontal mullion 212 is viewed at an intermediate point illustrating the placement of structural clip 374. Clip 374 is similar in design and construction to structural clip 74 described in FIG. 3 above. Its placement is again utilized for improving the dead load capacity of the mullion 318. The clip 374 may be formed of extruded aluminum or the like to control flare out of the mullion by maintaining, at the point of installation, the cross-sectional configuration established by the shear block 360 as viewed in FIG. 11 and secured at each end of said mullion. The clip 374 comprises one of the elements of complex or intricate design discussed above that may be provided in a configuration complemental to the structure of the roll-formed steel body 328. Such is the case with clip 374 constructed with oppositely disposed feet 376 and 377 engaging the inside areas of the surfaces 358 and 359 of the roll-formed body 328. It is the area between these roll-formed surfaces 358 and 359 that define the outer parameter of the glazing region wherein glazing gaskets 224 and 236 are positioned. This assembly is described in more detail in FIG. 11 where the shear block 360 is most clearly shown. Because mullion body 328 is hollow, the profile of the shear block 360 would ordinarily be seen and is removed herein for purposes of clarity in illustrating the clip 374. It may be seen that the clip 374, in this particular configuration, is specifically formed for matingly engaging the base of the glazing pocket 326 comprising the main region of web region 324. It may be seen that a number of configurations may be likewise matingly engaged and structurally secured as provided herein.

Referring now to FIGS. 1–13 collectively, it may be seen that the requisite tooling for roll forming such shapes can be provided in configurations that may be easily modified for minor changes in part dimensions. For example, by adding a spacer to the forming rolls (not shown) a different glazing pocket size can be formed and a complementally sized insert can accommodate a different size glass. Hence, one set of primary tooling can provide two or more distinctly differently systems. The size of the insert may also be changed to accommodate different kinds of glazing gaskets such as those necessitated by regional design and construction preferences. This modification may be made without altering the roll-formed tooling. Such a capability is a distinct advantage over aluminum extrusion designs. The multitude of advantages in roll-forming a series of shapes adapted for matingly engaging one another to provide the structural and functional aspects of vertical and horizontal mullions is a marked advance over the prior art. The roll-formed metal such as steel may in fact be provided in a gage thickness size that provides even greater structural integrity to the overall system than an equivalent size of extruded aluminum. This combined with the advantages of the interchangeable glazing adapters provides a marked advance over the prior art.

Still referring to the aspects of manufacturing, the present invention provides for the structural interengagement of interlocking roll-formed metal members. Not only is a single exposed side provided, but the requirements for seam welding and/or other forms of interconnection and securement are not necessary. The interlocking configuration effectively accommodates all requisite loading. In the horizontal mullion configuration described relative to FIGS. 2–5 and 10–13, the incorporation of the clip 74 further defines and manages the cross-sectional configuration of the body 28 at or around midspan by securing the engaged lip area between run-out ends 49 and 59 to improve the structural capacity thereof. It may be seen that a multitude of clips 74 may be incorporated wherever necessary and that enhanced structural integrity is provided therewith. While interference occurs between the clip 74 and a glazing adapter 33, the extruded adapter is easily cut or filed to receive the positioning of the clip therein. As referred to above, the feet 120 of glazing adapter 133 project outwardly of intermediate web 118. These feet 120 may be filed to afford clearance of the body section of a clip 74 and/or a shear block 60. This is shown most clearly in FIG. 5 where the interference between the glazing adapter 33 and shear block 60 can be seen. Such constructional aspects permit a design that utilizes approximately half of the roll-formed metal thickness necessary in the prior art. It is this structural configuration in fact that renders the present utilization of roll-formed metal feasible for a flush-glazed system.

Conclusion

As described above, the present invention provides a novel structural mullion system formed of a sufficiently thin roll-formed steel body for maximum structural integrity and economy in manufacturing. Shear blocks and securement clips are used for structural integrity and ease of assembly. They are formed of a complex design that is preferably extruded or molded. The profile of the mullion is then accurately defined at not only the interconnection joint between horizontal and vertical mullions but also along the length thereof. By presenting clip 74 and 374 along select areas of the length of the horizontal mullion, the dead loads presented thereon are effectively maintained. Conventional roll-formed construction utilizing thin wall thickness on the order of 0.029 inches would ordinarily present deflection and flare out failure under such loads. The present invention utilizes such thin gauged steel and related sizes in structurally sound configuration. The term "steel" as used herein includes, but is not limited to, stainless steel, coated steel and plated steel. The present invention, as described above, teaches a method of assembly of a structural mullion configuration for preventing galvanic corrosion and maximizing the effecting loading configuration thereacross. By permitting the shear blocks 393 to carry the dead load from the vertical mullions 214, there is minimum corrosion between rolled formed body 328 and flashing 390 due to the spaced engagement therebetween. Finally, another advantage described above is the availability of a single exposed profile in which a material can be treated only on a single side and that one side always presented outwardly. This maximizes both the manufacturing costs as well as the effectiveness of surface treating of such material. The thin cross-section configuration as herein provided and the utilization of the structural elements comprised of shear blocks 60 and 360 as well as clip 74 and 374 will provide means for utilizing such thin walled roll-formed construction in an assembly having maximum structural integrity and longevity.

Having described the invention in connection with certain specific embodiments thereof, it is to be understood that further modifications may now suggest themselves to those skilled in the art and it is intended to cover such modifications as fall within the scope of the appended claims.

I claim:

1. An improved mullion for a building system of the type wherein said mullion has a plurality of peripheral walls and web sections defining a load bearing structure and is adapted for supporting a panel adjacent thereto in sealed engagement therewith through sealing means secured therealong, the improvement comprising:

said mullion having a generally U-shaped body section;

said U-shaped body section being roll-formed from metal and further including a first hollow, integrally formed, generally L-shaped body section and a glazing stop upstanding therefrom:

said glazing stop and L-shaped body section being secured one to the other for defining a central glazing pocket therebetween;

said L-shaped body section being roll-formed from a width of metal whose edges terminate along a side thereof, said terminating edges being oppositely disposed on a base web portion of said body section, and said terminating edges also being rolled into oppositely disposed lip sections which permit tolerance variations in width of metal within said hollow, L-shaped body section; and an extruded member adapted for being received within said glazing pocket for the sealed engagement of a panel.

2. The apparatus as set forth in claim 1 wherein said L-shaped body section is roll-formed from a width of metal and said glazing stop is roll-formed from another width of metal into a generally C-shaped configuration adapted for matingly engaging said L-shaped body section.

3. The apparatus as set forth in claim 2 wherein said L-shaped body section is constructed with interior web sections wherein a first, transverse web region is formed with an upstanding portion defining a head section adapted for matingly engaging said generally C-shaped glazing stop.

4. The apparatus as set forth in claim 3 wherein said head section is formed with a height measured between said head and said underlying base web portion on the order of one-half or greater of the height of said orthogonal L-shaped portion measured between said base web portion and the end thereof.

5. The apparatus as set forth in claim 3 wherein said roll-formed steel of said C-shaped glazing stop has oppositely disposed terminating edges defining oppositely disposed heel and toe portions adapted for engaging said head section of said L-shaped body section in snap fit interengagement therewith.

6. An improved mullion for a building system of the type wherein said mullion has a plurality of peripheral walls and web sections defining a load bearing structure and is adapted for supporting a panel adjacent thereto in sealed engagement therewith through sealing means secured therealong, the improvement comprising:

said mullion having a generally U-shaped body section;

said U-shaped body section being roll-formed from metal and further including a first hollow, integrally formed, generally L-shaped body section and a glazing stop upstanding therefrom;

said glazing stop and L-shaped body section being secured one to the other for defining a central glazing pocket therebetween;

an extruded clip adapted for securement within said hollow L-shaped body section for defining at least a portion of the cross-sectional profile thereof; and an extruded member adapted for being received within said glazing pocket for the sealed engagement of a panel.

7. The apparatus as set forth in claim 6 wherein said extruded clip includes first and second legs extending outwardly from an intermediate web, said first and second legs being formed for engaging oppositely disposed sections of said L-shaped body section in securement therewith to define a profile of said L-shaped body section through structural interengagement therewith.

8. The apparatus as set forth in claim 6 wherein said roll-formed metal is steel.

9. An improved mullion for a building system of the type wherein said mullion has a plurality of peripheral walls and web sections defining a load bearing structure and is adapted for supporting a panel adjacent thereto in sealed engagement therewith through sealing means secured therealong, the improvement comprising:

said mullion having a generally U-shaped body section;

said U-shaped body section being roll-formed from metal and further including a first hollow, integrally formed, generally L-shaped body section and a glazing stop upstanding therefrom;

said glazing stop and L-shaped body section being secured one to the other for defining a central glazing pocket therebetween; and an extruded member adapted for being received within said glazing pocket for the sealed engagement of a panel, said extruded member including a pair of oppositely disposed yoke members adapted for engaging said sealing means.

10. An improved mullion for a building system of the type wherein said mullion has a plurality of peripheral walls and web sections defining a load bearing structure and is adapted for supporting a panel adjacent thereto in sealed engagement therewith through sealing means secured therealong, the improvement comprising:

said mullion having a generally U-shaped body section;

said U-shaped body section being roll-formed from metal and further including a first hollow, integrally formed, generally L-shaped body section and a glazing stop upstanding therefrom;

said glazing stop and L-shaped body section being secured one to the other for defining a central glazing pocket therebetween; and an extruded member adapted for being received within said glazing pocket for the sealed engagement of a panel, said extruded member comprising a glazing adaptor having oppositely disposed yoke regions adapted for engaging said sealing means.

11. The apparatus as set forth in claim 10 wherein said glazing adaptor is constructed of extruded aluminum.

12. The apparatus as set forth in claim 11 wherein said glazing adaptor is constructed of extruded plastic.

13. The apparatus as set forth in claim 10 wherein said L-shaped body section includes first and second orthogonal web regions defining a lateral hollow section of said body section adapted for projecting inwardly within a structure defined by said building system.

14. The apparatus as set forth in claim 13 wherein said L-shaped body section comprises at least four generally orthogonal web regions defining opposite cornered sections thereof and the internal and external perimeter of said mullion of said building system.

15. An improved mullion for a building system of the type wherein said mullion has a plurality of peripheral walls and web sections defining a load bearing structure and adapted for supporting a panel adjacent thereto in a sealed engagement therewith through sealing means secured therealong, the improvement comprising said mullion being roll-formed from thin gauged metal and further including a first, integrally formed, hollow, generally L-shaped body section and a glazing stop upstanding therefrom with said glazing stop and L-shaped body section being secured one to the other for defining a central glazing pocket therebetween, said mullion further including at least one mounting member adapted for being received within said hollow mullion for structural interengagement therewith, said mounting member comprising a shear block adapted for providing direct interengagement between orthogonally disposed mullions.

16. The apparatus as set forth in claim 15 wherein said mullions include vertical and horizontal mullions and said shear block is adapted for being secured within opposite ends of said horizontal mullion for direct interengagement with and securement to said vertical mullion for facilitating the orthogonal relationship therebetween.

17. An improved mullion for a building system of the type wherein said mullion has a plurality of peripheral walls and web sections defining a load bearing structure and adapted for supporting a panel adjacent thereto in a sealed engagement therewith through sealing means secured therealong, the improvement comprising said mullion being roll-formed from thin gauged metal and further including a first, integrally formed, hollow, generally L-shaped body section and a glazing stop upstanding therefrom with said glazing stop and L-shaped body section being secured one to the other for defining a central glazing pocket therebetween, said mullion further including at least one mounting member adapted for being received within said hollow mullion structural interengagement therewith, said mounting member including a support clip adapted for positioning within said hollow mullion at an intermediate point therealong for maintaining the cross-sectional profile thereof and affording structural integrity thereto.

18. An improved mullion for a building system of the type wherein said mullion has a plurality of peripheral walls and web sections defining a load bearing structure and adapted for supporting a panel adjacent thereto in a sealed engagement therewith through sealing means secured therealong, the improvement comprising said mullion being roll-formed from thin gauged metal and further including a first, integrally formed, hollow, generally L-shaped body section and a glazing stop upstanding therefrom with said glazing stop and L-shaped body section being secured one to the other for defining a central glazing pocket therebetween, said mullion further including at least one mounting member adapted for being received within said hollow mullion for structural interengagement therewith, said mounting member comprising an extruded element.

19. The apparatus as set forth in claim 18 wherein said extruded element is formed from aluminum in a configuration adapted for maximizing the structural support of said hollow mullion.

20. A mullion system operable to support a panel under loading conditions, said mullion system comprising:

a mullion body member formed of thin gauged, roll-formed metal, said body member having portions defining a glazing pocket and a hollow profile therealong;

means for mounting said panel within said glazing pocket of said body member;

a structural member adapted to be disposed within said mullion body member for the engagement and structural integrity thereof;

means for securing said structural member to said mullion body member for maintaining said mullion profile under said loading conditions; and said mullion comprising a horizontal mullion adapted to be secured to a vertical mullion and said structural member comprising a shear block adapted to be positioned within opposite ends of said horizontal mullion and securement to said vertical mullion for structurally supporting said horizontal mullion in generally orthogonal relationship to said vertical mullion.

21. The apparatus as set forth in claim 20 wherein said shear block comprises extruded aluminum structural elements adapted for facilitating the structural interengagement and support of said mullion.

22. A mullion system operable to support a panel under loading conditions, said mullion system comprising:

a mullion body member formed of thin gauged, roll-formed metal, said body member having portions defining a glazing pocket and a hollow profile therealong;

means for mounting said panel within said glazing pocket of said body member;

a structural member adapted to be disposed within said mullion body member for the engagement and structural integrity thereof;

means for securing said structural member to said mullion body member for maintaining said mullion profile under said loading conditions; and said structural member comprising a clip adapted for placement within an intermediate region of said hollow mullion for securing said thin gauge roll-formed metal portions thereof in said profile and providing structural integrity thereto whereby said profile is maintained under load.

23. The apparatus as set forth in claim 22 wherein said structural clip is an extruded aluminum element adapted for engaging roll-formed metal portions of said body member and maintaining said mullion profile.

24. A mullion system operable to support a panel under loading conditions, said mullion system comprising:

a mullion body member formed of thin gauged, roll-formed metal, said body member having portions defining a glazing pocket and a hollow profile therealong;

means for mounting said panel within said glazing pocket of said body member;

a structural member adapted to be disposed within said mullion body member for the engagement and structural integrity thereof;

means for securing said structural member to said mullion body member for maintaining said mullion profile under said loading conditions; and said mullion system including both vertical and horizontal mullions adapted for interconnection in generally orthogonal relationship one to the other, said structural members comprising a plurality of shear blocks adapted for securement in opposite ends of said horizontal mullions for facilitating structural interengagement with said vertical mullions, and at least one structural clip adapted for intermediate positioning within said horizontal mullion for maintaining the cross-sectional mullion profile thereof and, wherein at least one of said shear blocks further includes a depending leg section adapted for extending beneath said horizontal mullion in which it is disposed for interengagement with a support surface therebeneath for supporting said mullion system with said shear blocks.

25. The apparatus as set forth in claim 24 wherein said horizontal member within which said shear blocks having depending leg regions are disposed comprises a sill, and wherein said mullion system further includes flashing adapted for positioning beneath said sill, said shear block legs being adapted for resting upon said flashing whereby said horizontal and vertical mullions are disposed above said flashing and said underlying surface.

* * * * *

UNITED STATES PATENT AND TRADEMARK OFFICE

CERTIFICATE OF CORRECTION

PATENT NO. : 5,036,637

DATED : Aug. 6, 1991

INVENTOR(S) : Lawrence Biebuyck

It is certified that error appears in the above-identified patent and that said Letters Patent is hereby corrected as shown below:

Column 6, Line 32;
Delete "a" and Insert --an--

Column 13, Line 19;
Insert --11,-- after the word "FIG."

Column 13, Line 61;
Delete "o" and Insert --or--

Column 14, Line 9;
Delete "Off" and Insert --off--

Column 16, Line 64;
Insert --said-- after the word "in"

Signed and Sealed this

Second Day of March, 1993

*Attest:*

STEPHEN G. KUNIN

*Attesting Officer*

*Acting Commissioner of Patents and Trademarks*